United States Patent [19]

Kerrison

[11] 4,223,438

[45] Sep. 23, 1980

[54] DIRECT BAR OILER FOR CHAIN SAWS

[76] Inventor: Ronald L. Kerrison, Rosevears P.O., West Tamar, Tasmania 7251, Australia

[21] Appl. No.: 5,896

[22] Filed: Jan. 23, 1979

Related U.S. Application Data

[63] Continuation-in-part of Ser. No. 837,769, Dec. 19, 1977, abandoned.

[30] Foreign Application Priority Data

Dec. 31, 1976 [AU] Australia ..... PC8651

[51] Int. Cl.[3] ..... B27B 17/12

[52] U.S. Cl. ..... 30/123.4; 30/386

[58] Field of Search ..... 30/123.4, 383, 384, 30/385, 386; 184/15 R

[56] References Cited

U.S. PATENT DOCUMENTS

| | | | |
|---|---|---|---|
| 2,714,406 | 8/1955 | Smith | 30/123.4 |
| 2,718,908 | 9/1955 | Kiekhaefer | 30/123.4 |
| 2,748,810 | 6/1956 | Strunk | 30/123.4 |
| 2,933,112 | 4/1960 | Bentley | 30/386 |
| 3,044,506 | 7/1962 | Oehrli | 30/123.4 |
| 3,194,284 | 7/1965 | Walker | 30/386 |
| 3,870,125 | 3/1975 | Gorski | 30/383 |

*Primary Examiner*—Jimmy C. Peters

*Attorney, Agent, or Firm*—Sughrue, Rothwell, Mion, Zinn and Macpeak

[57] ABSTRACT

A chain saw oiling system in which the oil feed to the chain bar is carried through a modified form of the travelling nut which provides longitudinal adjustment of the chain bar.

7 Claims, 2 Drawing Figures

DIRECT BAR OILER FOR CHAIN SAWS

CROSS-REFERENCE TO RELATED APPLICATION

This application is a continuation-in-part of Ser. No. 837,769, filed Dec. 19, 1977 now abandoned.

FIELD OF THE INVENTION

The present invention relates to chain saws and particularly to directly lubricating the saw chain running on the guide bar of a chain saw.

BACKGROUND OF THE INVENTION

In a chain saw, the saw chain runs on a guide bar which is mounted on the chassis or power head of the chain saw. The guide bar is a flat, elongated bar which projects forwardly from the chain saw power head and has a rounded forward end which may, if desired, comprise a roller or sprocket. The guide bar has spaced peripherally extending side flanges which define between them a peripherally extending groove. The saw chain is a link chain customarily comprising side links having surfaces which slide on the outer edges of the peripheral side flanges of the guide bar and center links which are provided with tangs which extend into the peripheral groove of the bar. These tangs guide the chain on the guide bar and are engaged by a sprocket adjacent the inner end of the guide bar in order to drive the chain.

By reason of the sliding friction of the chain on the guide bar, it is necessary to lubricate the chain in order to prevent heating and rapid and excessive wear. For this purpose it is known to provide the guide bar with an oil hole extending through one of the side flanges of the guide bar near its inner end. On the chain saw power head there is provided an oil tank or chamber connected by suitable passageways to the oil hole in the guide bar. A manually or power operated pump is provided for delivering the lubricating oil from the oil tank or chamber to the oil hole of the guide bar. The oil passing through the hole is picked up by the tangs of the chain running in the groove of the guide bar and distributed around the guide bar so as to lubricate the surfaces on which the chain runs. Lubrication of the guide bar and chain is thus provided

BRIEF DESCRIPTION OF THE PRIOR ART

The prior art arrangements for attachment and oiling of chain saw guide bars typified by those described in U.S. Pat. No. 3,870,125 (Gorski) and particularly in FIG. 2 thereof.

In such arrangements the power head, which comprises a motor housed in a suitable casing, is provided with a mounting face against which the guide bar is clamped between shims or guard plates disposed on opposite sides of the guide bar., this assembly being mounted on bolts which project from the mounting face and pass through the shims and the guide bar and have clamping nuts on their free ends.

The mounting face usually also houses the adjustment means for tensioning the chain. Such adjustment means usually comprise a captive bolt mounted in a slot in the mounting face for rotation around an axis parallel to the chain bar. The bolt carries a nut which travels along the bolt, in response to rotation of the latter, and has a projecting finger which engages a corresponding hole in the chain bar. Thus by slackening off the clamping nuts, the longitudinal position of the chain bar relative to the power head, and hence the tension on the chain, can be adjusted by rotation of the captive bolt.

The mounting face includes one or more oil passages which are in fluid communication with corresponding apertures in the guide bar and receive oil from a tank behind the mounting face. The apertures are arranged so that oil fed from the passages in the mounting face pass through the apertures and thence through suitable ducts in the guide bar to the groove in which the saw chain runs.

Other forms of prior art chain saw follow this general arrangement and examples are depicted in U.S. Pat. Nos. 2,748,810 (Strunk) and U.S. Pat. No. 3,044,506 (Oehrli).

With all of these prior art devices, however, it has been found in practice that the oil hole in the guide bar frequently becomes clogged with saw-dust and dirt so that lubricating oil is not delivered to the groove of the guide bar. When this happens, excessive friction of the chain running on the guide bar results in increased drag on the chain, excessive heating and rapid wear which permanently damage the guide bar and chain.

SUMMARY OF THE INVENTION

It is an object of the present invention to alleviate the problem of oil hole clogging and to provide safe and dependable lubrication of the chain and guide bar of a chain saw.

Broadly stated, the present invention consists in modifying the prior art arrangement of the oil supply means and the chain tension adjustment means to combine the functions of both. In accordance with the present invention the oil feed to the chain bar is supplied through a modified form of the travelling nut which provides longitudinal adjustment of the chain bar.

More specifically the present invention provides, in a chain saw having a power head with a mounting face to receive a guide bar, a guide bar having an inboard end portion, means for removably securing the inboard end portion of said guide bar to the power head of the chain saw in a position overlying said mounting face, said guide bar having at its periphery two peripherally extending side flanges defining between them a peripherally extending groove, a saw chain running on said guide bar and comprising links having support surfaces sliding on outer edges of said side flanges to support the chain on the guide bar and links with tangs extending into said peripheral groove of the guide bar, said guide bar having in its inboard end portion an oil hole extending through one said side flange and opening into said peripheral groove, the improvement which comprises:

- a slot in the mounting face;
- a block housed within said slot for slidable movement along the slot, said block having at least one face thereof in liquid sealing contact with a wall of the slot, and an outer face substantially coplanar with said mounting face;
- a recess in the said face of the block and an oil supply duct in said wall of the slot arranged so that the supply duct and the said recess are in constant fluid communication, regardless of the position of the block along the slot;
- an oil supply tube mounted in and projecting from the outer face of the block;
- a passage extending through the block from the said slot to the said oil supply tube;

a finger attached to and projecting from the said outer face of the block which, in use, engages a corresponding hole in the chain bar for adjustment thereof;

means for positively locating the block at any desired position along the slot, whereby in use the said tube protrudes through the oil hole of the chain bar and into said peripheral groove.

Preferably the face of the block which contains the recess is the inner face, i.e., that face which is opposite to the outer face.

Preferably also, the means for adjusting the block comprises a captive bolts, i.e., as in the prior art.

BRIEF DESCRIPTION OF THE DRAWINGS

The objects and advantages of the present invention will be more fully understood from the following description in conjunction with the accompanying drawings which illustrate by way of example preferred embodiments of the invention and in which:

In FIG. 1, the power head casing 1 (shown only in part) has a raised mounting block 2, the operative face 3 thereof having a fairly deep slot 4, formed therein. An oil duct 6 opens into the slot 4 and is connected (by means not shown) to the normal oil supply pump and tank (also not shown) in the power head.

Figure 1:
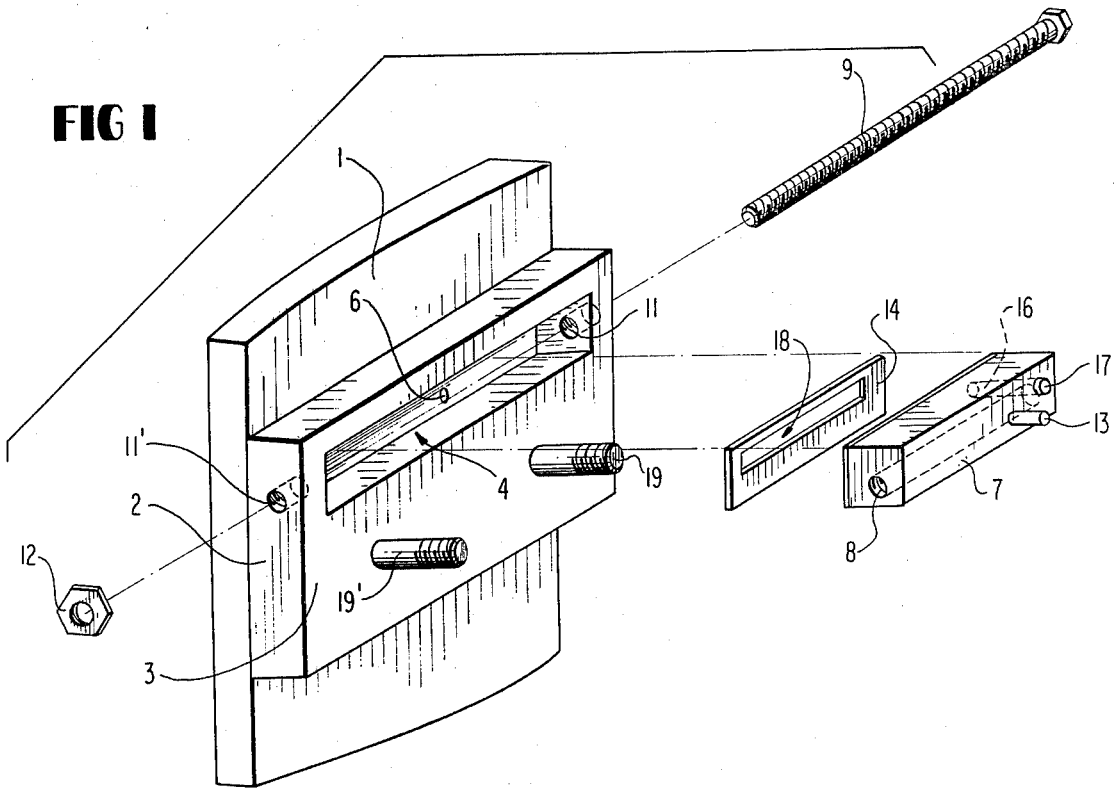
FIG. 1 is an exploded view showing the mounting face of the power head as modified in accordance with the invention.

The slot 4 houses a travelling block 7, which is shorter than the slot and which is a sliding fit in the slot. The block 7 has a threaded hole 8 running through its entire length and the block is secured in the slot by means of a bolt 9 which passes through the hole 8 and is journalled in holes 11, 11' in the end walls of the slot. A nut 12 is locked to the end of the bolt 9, to secure it against longitudinal displacement.

Figure 2:
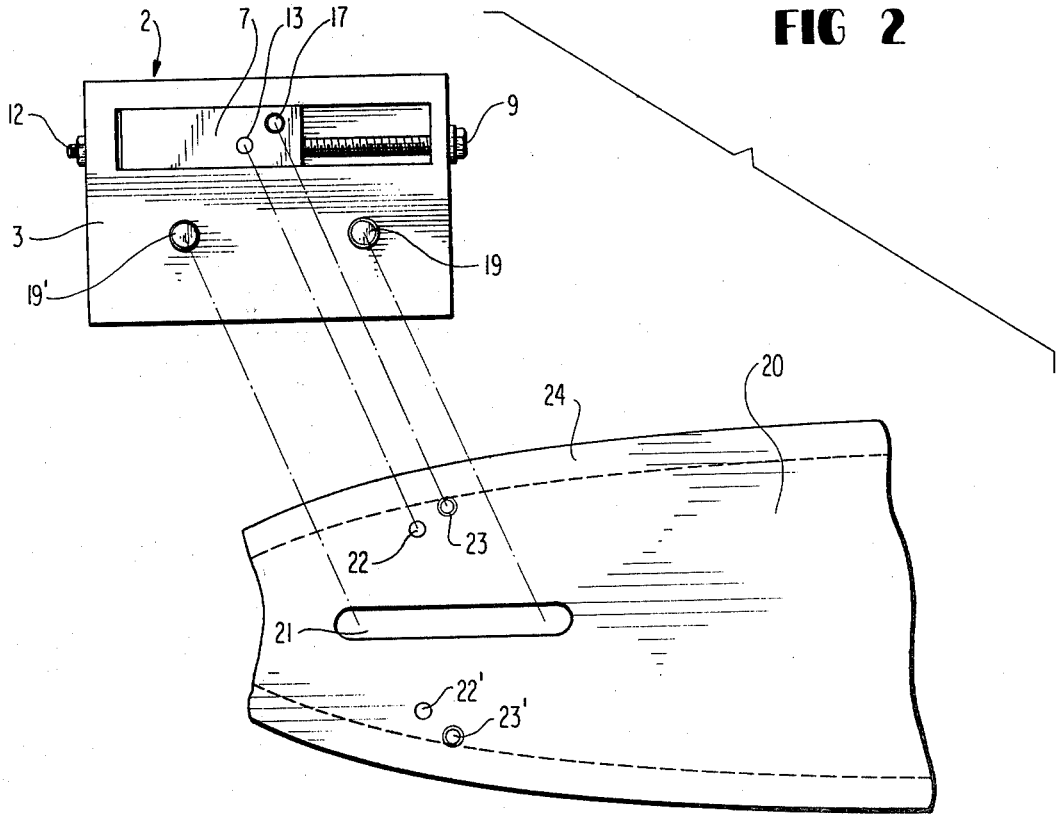
FIG. 2 is an exploded view showing how the saw bar is mounted on the mounting face. Both Figures are somewhat idealized.

The block 7 carries on its outer face (i.e. that which is parallel or coplanar with the operative face 3 of the mounting block 2) a pin or finger 13 which in use engages a corresponding aperture (22 or 22' in FIG. 2) in the chain bar 19. By rotating the bolt 9, the block 7 can be moved back and forth along the slot 4, thereby providing longitudinal adjustment of the chain bar.

A gasket 14 of neoprene, nylon or other suitable material is secured as by gluing or otherwise to the block 7 and is interposed between the rear surface of block 7 and the rear (or inner) wall surface of the slot 4. The gasket ensures liquid-sealing contact between the surface while allowing smooth movement of the block 7 within the slot 4.

The block 7 has an oil duct 16 which extends between its rear and front faces and has a tubular extension 17 which extends beyond the front face of the block.

The gasket 14 is pierced by a longitudinally-extending slot 18 which is situated so as to be in fluid communication with the ducts 6 and 16, thereby to provide fluid communication between the dusts. If desired the rear face of the block may have a recess (not shown) corresponding in length and extent to the slot 16.

The mounting block 2 has the usual mounting studs 19, 19' which project from its operating face 3, and pass through a corresponding slot 21 in the chain guide bar 20, which is secured to the operating face 3 by nuts (not shown) or the free ends of the studs 19, 19'. Usually the guide bar 20 is mounted between shims or guide plates (not shown). The chain bar, or rather the guide plate which will normally be between it and the operating face 3, also applies light clamping pressure against the outer face of the block 7, to ensure good liquid seal between the rear face of the block and to guard against accidental movement of the block while operating the saw.

As explained above the pin 13 engages a corresponding aperture 22 or 22' in the guide bar 20. The tube 17 in block 7 is arranged so that it projects through the oil hole 23 (or 23') in the chain bar and into the groove 24 in which run the drive links of the saw chain (not shown). In use oil supplied from the oil pump in the power head passed out of the duct 6, in the block 2, through the slot 18 in gasket and thence through the duct 16 to emerge from the tube 17 into the groove 24. The end of tube 17, is continuously cleared by the drive links of the saw chain, which pass close by the end of the tube 17.

The above-described arrangement overcomes the problems of blockage of oil ducts in the mounting face and the guide bar itself, of conventional chain saws. These ducts are normally blocked by sawdust accumulating in these areas. By developing a system where the oil is carried all the way into the guide bar groove the possiblility of blockage is eliminated and the high pressure oil feed from the power head is carried directly to the chain drive links. As the drive links of the chain pass the oiler tube they clean the end of it as they pick up the oil. The oiling system is thus more positive and less prone to the blockages usually encountered in prior art systems. An additional advantage lies in locating the bar adjusting screw above the bar studs, where it is in a more convenient position for adjustment.

While preferred embodiments of the invention have been illustrated in the drawings and are herein described, it will be understood that other modifications are possible within the scope of the invention.

I claim:

1. In a chain saw, the improvement which comprises carrying the oil feed to the chain bar through a modified form of the travelling nut which provides longitudinal adjustment of the chain bar.

2. A chain saw according to claim 1, wherein the oil supply is ducted directly from said nut into the peripheral groove of the chain bar in which run the drive links of saw chain.

3. In a chain saw having a power head with a mounting face to receive a guide bar, a guide bar having an inboard end portion, means for removably securing the inboard end portion of said guide bar to the power head of the chain saw in a position overlying said mounting face, said guide bar having at its periphery two peripherally extending side flanges defining between them a peripherally extending groove, a saw chain running on said guide bar and comprising links having support surfaces sliding on outer edges of said side flanges to support the chain on the guide bar and links with tangs extending into said peripheral groove of the guide bar, said guide bar having in its inboard end portion an oil hole extending through one said side flange and opening into said peripheral groove, the improvement which comprises:

a slot in the mounting face;

a block housed within said slot for slidable movement along the slot, said block having at least one face thereof in liquid sealing contact with a wall of the slot, and an outer face substantially coplanar with said mounting face;

a recess in the said face of the block and an oil supply duct in said wall of the slot arranged so that the supply duct and the said recess are in constant fluid communication, regardless of the position of the block along the slot;

an oil supply tube mounted in and projecting from the outer face of the block;

a passage extending through the block from the said slot to the said oil supply tube;

a finger attached to and projecting from the said outer face of the block which, in use, engages a corresponding hole in the chain bar for adjustment thereof;

means for positively locating the block at any desired position along the slot, whereby in use the said tube protrudes through the oil hole of the chain bar and into said peripheral groove.

4. A chain saw as claimed in claim 3, wherein the face of the block which contains the recess is the rear face.

5. A chain saw as claimed in claim 3, wherein the means for adjusting the block comprises a captive bolt.

6. A chain saw as claimed in claim 1, wherein a gasket is interposed between the face of said block and the wall of the slot thereby to facilitate liquid sealing contact between said face and said wall, the gasket having a slot therein in lieu of, or in addition to, the recess in the block.

7. A chain saw as claimed in claim 1, wherein the said oil supply tube is arranged to terminate in close proximity to the tangs of the saw chain, whereby the end of the tube is constantly cleared by the tangs when the saw is in operation.

* * * * *